US007838471B2

(12) United States Patent
Shirazi et al.

(10) Patent No.: US 7,838,471 B2
(45) Date of Patent: Nov. 23, 2010

(54) BLEND COMPRISING GROUP II AND GROUP IV BASESTOCKS

(75) Inventors: Fahimeh Pedram Shirazi, Belle Mead, NJ (US); William Grant Britton, Katy, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 1135 days.

(21) Appl. No.: 11/500,003

(22) Filed: Aug. 7, 2006

(65) Prior Publication Data

US 2007/0078070 A1 Apr. 5, 2007

Related U.S. Application Data

(60) Provisional application No. 60/722,534, filed on Sep. 30, 2005.

(51) Int. Cl.
*C10M 169/04* (2006.01)
*C10L 1/16* (2006.01)
*C07C 5/00* (2006.01)

(52) U.S. Cl. ..... 508/110; 508/591; 585/250

(58) Field of Classification Search ..... 508/591, 508/110; 585/250

See application file for complete search history.

(56) References Cited

U.S. PATENT DOCUMENTS

| | | | | |
|---|---|---|---|---|
| 5,693,598 | A | 12/1997 | Abraham et al. | 508/444 |
| 5,789,355 | A | 8/1998 | Adams et al. | 508/241 |
| 6,303,548 | B2 | 10/2001 | Gao | 508/469 |
| 6,824,671 | B2 | 11/2004 | Goze et al. | 208/19 |
| 6,949,688 | B2 | 9/2005 | Goze et al. | 585/525 |
| 2001/0007851 | A1 | 7/2001 | Gao | 508/469 |
| 2003/0171223 | A1 | 9/2003 | Winemiller et al. | 508/192 |
| 2004/0033908 | A1 * | 2/2004 | Deckman et al. | 508/110 |

FOREIGN PATENT DOCUMENTS

| | | |
|---|---|---|
| WO | WO 02/092729 | 11/2002 |

* cited by examiner

*Primary Examiner*—Walter D Griffin
*Assistant Examiner*—Frank C Campanell
(74) *Attorney, Agent, or Firm*—Nancy T. Krawczyk; Andrew B. Griffis

(57) ABSTRACT

The invention relates to compositions comprising a blend of Group II basestocks and low volatility, low viscosity PAO basestocks. The blend is particularly useful for preparing finished lubricants that meet or even exceed the criteria for SAE Grade 0W multi-grade engine oils. The combination of these low volatility, low viscosity PAOs with Group II basestocks provide, in embodiments, the necessary performance criteria in automatic transmission fluids, automotive or industrial gear oils, hydraulic fluids, or any other high performance lubricant requiring a combination of excellent low fluidity and low volatility.

19 Claims, 3 Drawing Sheets

BLEND COMPRISING GROUP II AND GROUP IV BASESTOCKS

CROSS REFERENCE TO RELATED APPLICATION

This application claims the benefit of Provisional Application No. 60/722,534 filed Sep. 30, 2005, the disclosure of which is incorporated by reference.

FIELD OF THE INVENTION

The invention relates to compositions comprising a blend of Group II basestocks and low volatility, low viscosity PAO basestocks. The blend is particularly useful for preparing finished lubricants that meet or even exceed the criteria for SAE Grade 0W multi-grade engine oils.

BACKGROUND OF THE INVENTION

Current technology requires either catalytically dewaxed, wax isomerate based Group III basestocks, or polyalphaolefins (PAOs) as the primary basestock to achieve certain requirements set by organizations such as ACEA (Association des Constructeurs d' Automobiles), ATIEL (Association Technique de L'Industrie Europeane des Lubrifiants), API (American Petroleum Institute), ILSAC (International Lubricant Standardization and Approval Committee), ASTM (American Society of Testing and Materials), EOLCS (Engine Oil Licensing and Certification System), SAE (Society of Automotive Engineers) for applications requiring excellent low temperature properties as well as high temperature stability. An example is SAE Grade 0W multi-grade engine oils and ILSAC GF-4 specifications. There is currently a limited supply of both of these relatively expensive basestocks and development of alternatives is needed to meet growing demand. Technology to enable the use of more petroleum-derived basestocks in such formulations is highly sought-after.

U.S. Pat. No. 5,693,598 describes a low viscosity oil having a kinematic viscosity of up to about 4 cSt at 100° C. and a composition having antiwear properties and comprising said oil. The feed comprises from about 60 to about 90% C12.

U.S. Pat. No. 5,789,355 relates to SAE Grade 5W and higher multigrade oils including a basestock and a detergent inhibitor package. The basestock is selected from API Groups I and II. The detergent inhibitor package includes an ashless dispersant derived from an ethylene alphaolefin (EAO).

U.S. Pat. No. 6,303,548 is directed to a base oil for an SAE Grade 0W40 lubricant composition comprising a PAO and a synthetic ester lubricant.

U.S. Pat. No. 6,824,671 describes a mixture of about 50 to 80 wt. % 1-decene and about 20 to 50 wt. % 1-dodecene are co-oligomerized in two continuous stirred-tank reactors in series using BF3 with an ethanol:ethyl acetate promoter. Monomers and dimers are taken overhead and the bottoms product is hydrogenated to saturate the trimers/oligomers to create a 5 cSt PAO. This product is further distilled and the distillation cuts blended to produce a 4 cSt PAO containing mostly trimers and tetramers, and a 6 cSt PAO containing trimers, tetramers, and pentamers. The lubricants thus obtained are characterized by a Noack volatility of about 4% to 12%, a pour point of about −40° C. to −65° C. See also copending U.S. application Ser. No. 10/959,544.

U.S. Patent Application 2004/0033908 describes a fully-formulated lubricant comprising PAOs, including a PAO prepared from an oligomerization process comprising contacting an alphaolefin feed with a $BF_3$ catalyst and a promoter (or cocatalyst) system including an alcohol and an ester.

The use of Group III lube basestocks blended with Group II basestocks is currently available commercially to make 5W-XX engine oils (where XX can be 10, 20, 30, 40). However, as far as the present inventors are aware, heretofore no 0W-XX engine oil has been formulated using a Group II basestock.

The present inventors have surprisingly discovered that this same new low viscosity PAO allows for blending of a high percentage of Group II basestock to achieve an engine oil capable of meeting 0W-XX requirements.

SUMMARY OF THE INVENTION

The invention is directed to compositions comprising a blend of (a) Group II basestocks, and (b) low volatility, low viscosity PAO basestocks characterized by a low kinematic viscosity, a low Noack volatility, and a low pour point.

The invention is also related to a process for producing a blend comprising (a) at least one Group II basestock and (b) a PAO according to the invention.

In preferred embodiments, the PAO according to the invention is characterized as obtainable by a process comprising contacting at least one alphaolefin with an oligomerization catalyst in the presence of a dual promoter system comprising at least one alcohol and at least one ester.

In preferred embodiments, the PAO according to the invention is characterized as made by a process comprising contacting at least one alphaolefin with an oligomerization catalyst in the presence of a dual promoter system comprising at least one alcohol and at least one ester.

In preferred embodiments, the PAO according to the invention is characterized as having a pour point less than −54° C., and at least one of the following relationships: (i) a Noack volatility versus CCS relationship on or below curve A in FIG. 1; (ii) a Noack volatility versus CCS relationship on or below curve B in FIG. 1; (iii) a Noack volatility to KV relationship on or below the curve A in FIG. 2; (iv) a Noack volatility to KV relationship on or below the curve B in FIG. 2; (v) a Noack volatility to KV relationship on or below the curve A in FIG. 3; (vi) a Noack volatility to KV relationship on or below the curve B in FIG. 3. Preferably two or more, or three or more, or four or more, or five or more, or all six of these relationships hold.

In preferred embodiments, the PAO according to the invention is characterized by a pour point less than −54° C., and a Noack volatility to KV at 100° C. relationship such that: (ia) within the range of 3.5 to 3.95 cSt at 100° C. the Noack Volatility=$(900)(KV)^{-3.2}$; and (ib) within the range of greater than 3.95 to 6 cSt at 100° C. the Noack Volatility=$(175)(KV)^{-2}$.

In preferred embodiments, the Group II basestock used in the composition or blend according to the invention is used in the amount of equal or greater than 30 wt %, based on the weight of the final formulated oil.

In preferred embodiments, the PAO characterizable by a low kinematic viscosity, low Noack volatility, and a low pour point is used without blending with other PAOs.

It is an object of the invention to provide a convenient method of upgrading conventional petroleum-derived basestock, specifically Group II basestocks, into premium lubricant applications capable of meeting new requirements related to cold temperature performance and lower volatility.

It is further an object of the invention to provide an improved lubricant basestock blend, the improvement comprising an improved pour point as well as at least one of the properties defined by (i) through (vi) set forth above.

These and other objects, features, and advantages will become apparent as reference is made to the following detailed description, preferred embodiments, examples, and appended claims.

Figure 1:
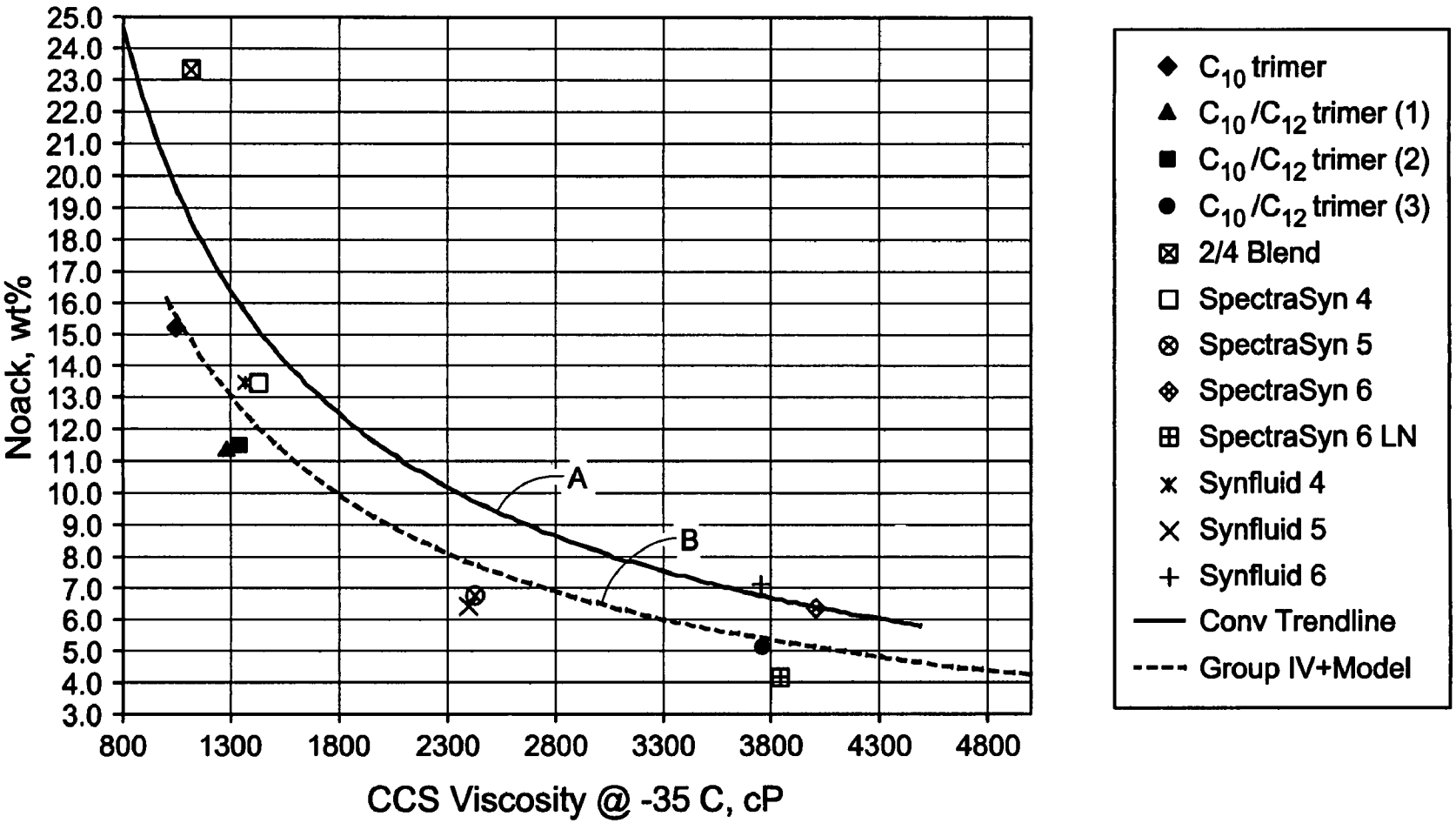
FIG. 1 illustrates the relationship of Noack Volatility versus Cold Crank Simulator (CCS) test @ −35° C. for PAOs according to the present invention compared with prior art compositions.

In each drawing the top curve is referred to as Curve A and the bottom curve is referred to as Curve B in the following description.

DETAILED DESCRIPTION

According to the invention, a blend is provided comprising (a) at least one Group II basestock, and (b) at least one PAO basestock according to the invention, which may be characterized as a PAO having a low kinematic viscosity, a low Noack volatility, and a low pour point, or in preferred embodiments as obtainable by a process comprising contacting at least one alphaolefin with an oligomerization catalyst in the presence of a dual promoter system comprising at least one alcohol and at least one ester, or in other preferred embodiments a made by a process comprising contacting at least one alphaolefin with an oligomerization catalyst in the presence of a dual promoter system comprising at least one alcohol and at least one ester.

Group II Basestock

The first component of the composition according to the present invention is selected from at least one Group II basestock.

As used herein, the term "Group II basestock" refers to the API Group II basestocks. Group II basestocks are characterized by a sulfur content of less than or equal to 300 ppm, saturates greater than or equal to 90 wt. %, and a viscosity index (VI) in the range of 80 to 120. Typically such basestocks will be petroleum-derived, however, any natural oil characterizable as a Group II basestock may be used, including animal oils and vegetable oils, as well as mineral lubricating oils such as liquid petroleum oils and solvent treated or acid-treated mineral lubricating oils of the paraffinic, naphthenic or mixed paraffinic/naphthenic types which may be further refined by vacuum distillation, hydrocracking, hydrotreating and/or hydrofinishing and are dewaxed. Group II basestocks are available from a wide number of commercial sources.

Group II basestocks useful in the present invention may also be characterized as mineral oils that are severely hydrotreated or hydrocracked and have the aforementioned characteristics specified by API for Group II basestocks. These processes expose the mineral oils to very high hydrogen pressures at elevated temperatures in the presence of hydrogenation catalysts. Typical processing conditions include hydrogen pressures of approximately 3000 pounds per square inch (psi) at temperatures ranging from 300° C. to 450° C. over a hydrogenation-type catalyst. This processing removes sulfur and nitrogen from the lubricating oil and saturates any alkylene or aromatic structures in the feedstock. The result is a base oil with extremely good oxidation resistance and viscosity index. A secondary benefit of these processes is that low molecular weight constituents of the feed stock, such as waxes, can be isomerized from linear to branched structures thereby providing finished base oils with significantly improved low temperature properties. These hydrotreated base oils may then be further de-waxed either catalytically or by conventional means to reduce their pour point and improve their low temperature fluidity.

A particular advantage of the present invention is that wax isomerate API Group III materials are not necessary in a composition according to the invention in order to achieve certain specifications discussed in the Background section. Accordingly, in an embodiment, API Group III wax isomerate materials are excluded from a composition according to the invention.

While not critical to the broad invention contemplated, Group II basestocks may also be characterized by performance on the Cold Crank Simulator test (CCS), as discussed more fully below. A fully formulated SAE Grade 0W engine oil needs to have a CCS at −35° C. of 6200 or less. Heretofore a fully formulated 0W engine oil using an appreciable amount of Group II basestock (e.g., equal or greater than 30 vol. %) required a Group II basestock having a CCS at −35° C. of 2600 or less. Using the PAO according to the invention, appreciable concentrations of Group II basestocks having CCS at −35° C. of greater than 2600, or greater than 2700, or greater than 2800, or even greater, can be blended in to achieve SAE Grade 0W engine oils. This is a greater advantage of the present invention.

Preferred Group II basestocks include EHC 45™ (with saturate contents of 96%) and EHC 60™ (with saturate contents of 95%), available from ExxonMobil Corporation.

Also preferred are Group II materials that are characterizable by having a viscosity of 3 cSt or greater, or more preferably greater than 3 cSt.

Low Volatility, Low Viscosity PAO Basestocks

The second component of a composition according to the present invention is at least one PAO basestock characterized by a low kinematic viscosity, a low Noack volatility, and a low pour point.

PAOs and methods of making PAOs useful in the present invention have been described recently in U.S. Pat. No. 6,824,671; and U.S. Patent Application 2004/0033908 and are also described in commonly assigned, copending application Ser. No. 60/662,728.

In an embodiment, the PAOs useful in the present invention are made by a process comprising contacting a feed comprising at least one alphaolefin with an oligomerization catalyst and a dual promoter (or cocatalyst) system comprising an alcohol and an ester, and oligomerizing said at least one alphaolefin to obtain a product comprising substantially a trimer of said at least one alphaolefin.

A preferred PAO according to the invention is at least one trimer rich oligomer produced by controlling the degree of polymerization with the use of the dual promoter system comprising ester and alcohol. The process comprises contacting a feed comprising at least one α-olefin with a catalyst comprising $BF_3$ in the presence of a promoter comprising an alcohol and acid or an ester formed therefrom, in two or more continuously stirred reactors connected in series, under oligomerization conditions. Products lighter than trimers are distilled off after polymerization from the second reactor vessel and the bottoms product is hydrogenated. The hydrogenation product is then distilled to yield a trimer-rich product. In an embodiment the products are narrow cut (narrow molecular weight distribution), low viscosity, low Noack volatility PAOs. In another embodiment the bottoms product obtained is used without blending with a second PAO.

In an embodiment, the product is a narrow cut (narrow molecular weight), low viscosity, low Noack volatility PAO. As used herein, the term "narrow cut" means narrow molecular weight range. In its most preferred embodiment, for the present invention, narrow cut, low viscosity, low Noack volatility PAOs will comprise a very high percentage of trimers of the at least alphaolefin feed, preferably at least 85 wt. %, more preferably at least 90 wt. %, still more preferably at least 95 wt. %, yet still more preferably at least 99 wt. % trimer. The meaning of the term "narrow molecular weight range" may be understood by one of ordinary skill in the art in view of the foregoing.

The feed comprises at least one α-olefin. The terms "α-olefin" and "alphaolefin" are used interchangeably herein. The alphaolefins may be selected from any one or more of C3 to C21 alphaolefins, preferably C6 to C16 alphaolefins and more preferably at least one species selected from 1-octene, 1-decene, 1-dodecene, and 1-tetradecene. It is preferred that the alphaolefins are linear alphaolefins (LAOs). Mixtures of any of these alphaolefins mentioned may also be used.

In a preferred embodiment, at least two species selected from 1-octene, 1-decene, 1-dodecene, and 1-tetradecene are used in the feed. In another preferred embodiment, the feed comprises greater than or equal to 40 wt. % 1-decene, or greater than 40 wt. % 1-decene, or greater than or equal to 50 wt. % 1-decene.

In another preferred embodiment, the olefin feed consists essentially of greater than or equal to 40 wt. % 1-decene, or greater than 40 wt. % 1-decene, or greater than or equal to 50 wt. % 1-decene, with the remainder of the olefin feed consisting essentially of one or more of species selected from 1-octene, 1-dodecene, and 1-tetradecene.

In another preferred embodiment the olefin feed consists essentially of 1-decene, in yet another preferred embodiment the olefin feed consists essentially of 1-decene and 1-dodecene, in still another preferred embodiment the olefin feed consists essentially of 1-dodecene and 1-tetradecene, and in yet still another preferred embodiment the feed consists essentially of 1-dodecene.

In an embodiment, the feed comprises 1-decene. In a preferred embodiment, the feed consists essentially of 1-decene and a promoter according to the invention, co-fed into the reactor comprising an oligomerization catalyst, and the product of the process according to the invention comprises a distillation cut characterized by a viscosity of about 3.6 cSt at 100° C.

In another embodiment, the feed consists essentially of 1-decene, 1-dodecene, and promoter according to the invention, co-fed into the reactor comprising an oligomerization catalyst, and the product of the process according to the invention comprises a distillation cut characterized by a viscosity of about 3.9 cSt at 100° C.

In an embodiment, the olefins used in the feed are co-fed into the reactor. In another embodiment, the olefins are fed separately into the reactor.

In addition to the presence of a conventional $BF_3$ oligomerization catalyst, at least two different promoters (or cocatalysts) are also present. According to the present invention, the two different promoters are selected from (i) alcohols and (ii) esters, with at least one alcohol and at least one ester present.

Alcohols useful in the process of the invention are selected from C1-C10 alcohols, more preferably C1-C6 alcohols. They may be straight-chain or branched alcohols. Preferred alcohols are methanol, ethanol, n-propanol, n-butanol, n-pentanol, n-hexanol, and mixtures thereof.

Esters useful in the process of the invention are selected from the reaction product(s) of at least one alcohol and one acid. The alcohols useful to make esters according to the invention are preferably selected from the same alcohols set forth above, although the alcohol used to make the ester for the promoter used in (ii) may be different than the alcohol used as promoter in (i), or it may be the same alcohol. The acid is preferably acetic acid, although it may be any low molecular weight mono-basic carboxylic acid, such as formic acid, propionic acid, and the like.

It will be recognized by one of ordinary skill in the art that in the case where the alcohol in (i) is different than the alcohol used in (ii) that there may be some dissociation of the ester in (ii) so that it may be difficult to say exactly what the species of alcohol(s) and ester(s) are with precision. Furthermore, (i) and/or (ii) may be added separately from each other or added together, and separately or together with one or more of the olefin feed(s). It is preferred that $BF_3$ and acid/ester be added in the feed together with the one or more alphaolefin.

In this process, it is preferred that the ratio of the group (i) cocatalysts to group (ii) cocatalysts (i.e., (i): (ii)) range from about 0.2:1 to 15:1, with 0.5:1 to 7:1 being preferred.

As to the boron trifluoride, it is preferred that it be introduced into the reactor simultaneously with cocatalysts and olefin feed. In the case of more than one continuously stirred reactor connected in series, it is preferred that BF3, cocatalyst and olefin feed be introduced only to the first reactor, and preferably simultaneously. It is further preferred that the reaction zone(s) contain an excess of boron trifluoride, which is governed by the pressure and partial pressure of the boron trifluoride. In this regard, it is preferred that the boron trifluoride be maintained in the reaction zone at a pressure of about 2 to about 500 psig, preferably about 2 to 50 psig (1 psi=703 $kg/m^2$). Alternatively, the boron trifluoride can be sparged into the reaction mixture, along with other known methods for introducing the boron trifluoride to the reaction zone.

Suitable temperatures for the reaction are also conventional and can vary from about −20° C. to about 90° C., with a range of about 15° to 70° C. being preferred. Appropriate residence times in each reactor, and other further details of processing, are within the skill of the ordinary artisan, in possession of the present disclosure.

In an embodiment, after steady-state conditions are achieved in the final reactor, product from the final or last reactor is sent to a first distillation column, wherein the unreacted monomers and promoters are distilled off. Steady-state conditions may be ascertained by one of ordinary skill in the art in possesson of the present disclosure, e.g., when QI (as discussed below) of samples taken from the final reactor does not change. The bottoms product is then sent to a second distillation column where dimers are distilled off. In embodiments, for instance in the case where the dimers are a desired product, the bottoms product is preferably first hydrogenated prior to distillation of the dimers. A useful dimer product may be, for instance, a PAO having a nominal 2 cSt viscosity. In an alternative, dimers are first distilled off and the bottoms product from the second distillation product is then hydrogenated.

The products taken off overhead from this hydrogenated bottoms product, in a third distillation column, preferably will be a narrow cut, meaning a high percentage of trimer. In an embodiment, the product comprises at least 85 wt. % trimer. In another embodiment, the product comprises at least 95 wt. % trimer. In still another embodiment, the product comprises about 99 wt. % trimer and about 1 wt. % tetramer. The actual molecular weight range will depend on the feed.

Thus, with a feed consisting essentially of 1-decene, a preferred product will be a narrow cut having, for instance, 85 wt. % C30 PAO. In the case of a feed consisting essentially of 1-decene and 1-dodecene, a preferred product will be a narrow cut having, for instance, 85 wt. % C30, C32, C34, C36 PAO. The percentages of each specific carbon number can be attenuated by one of ordinary skill in the art in possession of the present disclosure.

The bottoms product from this third distillation column also yields a useful PAO product, e.g., a PAO having a nominal 6 cSt viscosity.

In an embodiment, a particular advantage of the present invention is the surprising discovery that the viscosity can be controlled by the ratio of alcohol to ester, with the higher viscosity achieved by having a higher alcohol:ester ratio. The degree of polymerization may also be attenuated more finely by controlling the concentration of the alcohol and the ester. This is, again, within the skill of the ordinary artisan in possession of the present disclosure.

EXAMPLES

In the following examples the improvement in the selectivity of trimer yield is indicated by the parameter QI, which is the ratio of wt. % trimer to the sum of wt. % of trimers, tetramers and higher oligomers. The results are set forth in Tables 1 and 2. The properties of the narrow cut trimers and the co-products made in the same process are shown in Tables 3 and 4. These are compared to the conventional PAO's that have similar viscosity. The examples are meant to illustrate the present invention, and it will be recognized by one of ordinary skill in the art in possession of the present disclosure that numerous modifications and variations are possible. Therefore, it is to be understood that within the scope of the appended claims, the invention may be practiced otherwise than as specifically described herein.

Example 1

Comparative 1-decene was oligomerized in two continuous stirred-tank reactors in series at 18° C. and 5 psig using a feed consisting essentially of olefin, $BF_3$ and $BF_3$.butanol (complex of the catalyst and the alcohol). The free $BF_3$ concentration was 0.1 wt. % (1.8 mmoles/100 parts olefin feed); the weight ratio of $BF_3$ to $BF_3$.alcohol complex in the feed was 0.2:1. Residence times in the primary and secondary reactors were 1.4 hrs and 1 hr, respectively. When the system reached steady-state, a sample was taken from the second reactor and the composition of the crude polymer was determined by gas chromatography (GC). The % conversion and QI, shown in Table 1, were computed from the GC results. The QI obtained was 0.375, meaning that only 37.5% of the mixture of oligomers (trimers and higher) were trimers.

Example 2

As Example 1, except that the promoter system had $BF_3$.butanol and $BF_3$.butyl acetate and the residence times in the primary and secondary reactors were 0.5 hr and 1.3 hrs, respectively. The mole ratio of butanol to butyl acetate was 7 to 1; the weight ratio of free to complexed $BF_3$ is 0.1:1. With the addition of $BF_3$.butyl acetate in the promoter system, the conversion was lower and more trimers were produced as indicated by the higher QI of Example 2 compared to that of Example 1, as shown in Table 1.

Example 3

Same as Example 2, except that the concentration of the $BF_3$.butyl acetate complex was increased so that the promoter system had a $BF_3$.butanol:$BF_3$.butyl acetate ratio of 4:1; the weight ratio of free to complexed $BF_3$ was 0.08:1. With the incorporation of more acetate in the promoter system, conversion is similar to that in Example 2, while the QI of the polymer, also shown in Table 1, is increased to 0.651.

Example 4

Same as Example 2, except that the promoter system had a still further increase in $BF_3$.butyl acetate so that the ratio of $BF_3$-butanol to $BF_3$-butyl acetate was 2.5:1, the reaction temperature was at 21° C., and the residence times in the primary and secondary reactors were 1.7 hrs and 0.7 hr, respectively. Again, as shown in Table 1, the QI increased still further with the simultaneous increase in temperature and acetate content, despite the higher conversion attained.

TABLE 1

| 1-Decene Feed | | | | | |
|---|---|---|---|---|---|
| Ex. | Promoter System | Reaction Temperature | Residence Time in Primary/ Secondary Reactors (in hours) | % Conversion | QI |
| 1 | BF3-Butanol | 18° C. | 1.4/1 | 80 | 0.375 |
| 2 | 7:1 BF3-Butanol/ BF3-Butyl acetate | 18° C. | 0.5/1.3 | 76 | 0.575 |
| 3 | 4:1 BF3-Butanol/ BF3 Butyl Acetate | 18° C. | 0.5/1.3 | 76 | 0.651 |
| 4 | 2.5:1 BF3-Butanol/ BF3-Butyl Acetate | 21° C. | 1.7/0.7 | 90 | 0.733 |

Example 5

Comparative

Same as Example 1, except that the feed was a mixture containing 70 wt. % 1-decene and 30 wt. % 1-dodecene, the promoter system was $BF_3$.ethanol and the residence times in the primary and secondary reactors were 1.3 hrs and 0.94 hr, respectively. The conversion and QI of the polymer are shown in Table 2. By using a mixture of 1-decene and 1-dodecene and lower molecular weight alcohol than that used in Example 1, the QI increased to 0.51.

Example 6

Same as Example 5, except that a dual promoter system of $BF_3$.ethanol and $BF_3$ ethyl acetate was used, in the ratio of 12:1. The addition of $BF_3$.ethyl acetate to the promoter system resulted in a QI that was higher than that of Example 5, as shown in Table 2, below, even though the conversion of Example 5 was lower.

Example 7

Same as Example 5, except that the promoter system used was 3.5:1 in $BF_3$.butanol:$BF_3$.butyl acetate. The QI still increased even when a higher molecular weight alcohol-alkyl acetate system was used. The conversion, however, was lower.

Example 8

Same as Example 7 except that the olefin feed mixture contained 60 wt. % 1-decene and 40 wt. % 1-dodecene. When the feed mixture contained more 1-dodecene, the QI was reduced even if the conversion was similar to that of Example 7.

TABLE 2

| 1-Decene/1-Dodecene feed | | | | | | |
|---|---|---|---|---|---|---|
| Ex. | C10/C12 Ratio Wt./Wt. | Promoter System | Reaction Temperature | Residence Time in Primary/Secondary Reactors (in hours) | % Conversion | QI |
| 5 | 70:30 | BF3-Ethanol | 18° C. | 1.3/0.94 | 88 | 0.51 |
| 6 | 70:30 | 12:1 BF3-Ethanol/ BF3 Ethyl Acetate | 18° C. | 1.3/0.94 | 93 | 0.582 |
| 7 | 70:30 | 3.5:1 BF3-Butanol/ Butyl Acetate | 18° C. | 1.3/0.94 | 85 | 0.682 |
| 8 | 60:40 | 3.5:1 BF3-Butanol/ Butyl Acetate | 18° C. | 1.3/0.94 | 86 | 0.671 |

Example 9

Comparative

A low viscosity mixture containing 7.2 wt. % PAO with a nominal viscosity of 2 cSt and 92.8 wt. % of PAO with nominal viscosity of 4 cSt, was made from commercial samples. The properties are shown in Table 3, below. Although the blend's viscosity was low, the Noack volatility was high due to the high dimer content.

Also shown in Table 3 are two references—Reference A (SpectraSyn™ 4 PAO) and Reference B (Synfluid® 4 PAO). These are both commercially-available PAOs from ExxonMobil Chemical Company and Chevron Phillips, respectively, with nominal viscosity of 4 cSt. Both references have broad molecular weight distribution as indicated by oligomer distribution.

Example 10

This example used the product obtained in Example 4. In Example 4, a sample was taken from the second reactor when steady-state condition was attained. This sample was distilled to remove the monomer and dimer. The bottoms stream was hydrogenated to saturate the trimer and higher oligomers. The hydrogenated product was distilled and two cuts of PAO were obtained, one (overheads) with a nominal viscosity of 4 cSt, shown as Example 10A in Table 3, below, and one (bottoms product) with a nominal viscosity of 6 cSt, shown as Example 10B in Table 4, further below.

From Example 10A, the PAO that had a nominal viscosity of 4 cSt produced in this process was mostly trimers—greater than 95% trimers. It had a narrow molecular weight distribution and had a 100° C. and −40° C. viscosities that were lower than the references. It also had a good Noack volatility.

The co-product, shown in Table 4, had a nominal viscosity of 6 cSt and better Noack volatility and low temperature viscosity than conventional, commercially available 1-decene-based PAO that has a nominal viscosity of 6 cSt (Reference C, commercially-available, nominal 6 cSt PAO, from ExxonMobil Chemical Company).

Example 11

Same as Example 10, except using the product produced in Example 8 instead of Example 4. The PAO produced that had a nominal viscosity of 4 cSt, shown as Example 11A in Table 3, was also narrow cut and had better low temperature viscosity and Noack volatility than the conventional PAOs that have a nominal viscosity of 4 cSt (References A and B).

The co-product cut, Example 11B, had a nominal viscosity of 6 cSt and was also superior to both commercially available C10-based and mixed olefin-based (C8/C10/C12) references, C and D, respectively. Reference D is commercially-available, also a nominal 6 cSt PAO, from ExxonMobil Chemical Company.

TABLE 3

| Properties of Narrow Cut Trimers (overheads) | | | | | | |
|---|---|---|---|---|---|---|
| Ex. | Feed | 100° C. K.V. (cSt) | −40° C. K.V. (cSt) | VI | Noack Volatility (wt. %) | Oligomer Distribution Dimer/Trimer/Tetramer/ Pentamer (wt. %) |
| Ref A | C10 | 4.00 | 2728 | 123 | 12.4 | 0.8/77.8/18.3/3.1 |
| Ref B | C10 | 3.81 | 2387 | 122 | 14.2 | 0.8/87/11.6/0.6 |
| 9 | C10 | 3.86 | 2383 | 125 | 17.8 | 7.5/67.8/20.4/4.3 |

TABLE 3-continued

| Properties of Narrow Cut Trimers (overheads) | | | | | | |
|---|---|---|---|---|---|---|
| Ex. | Feed | 100° C. K.V. (cSt) | −40° C. K.V. (cSt) | VI | Noack Volatility (wt. %) | Oligomer Distribution Dimer/Trimer/Tetramer/ Pentamer (wt. %) |
| 10A | C10 | 3.62 | 2057 | 121 | 15.5 | 0/95.2/4.8/0 |
| 11A | 60:40 C10:C12 | 3.86 | 2499 | 126 | 11.3 | 0.8/96.7/2.5/0 |

TABLE 4

| Properties of Co-Products of Narrow Cut Trimers (bottoms product) | | | | | |
|---|---|---|---|---|---|
| Ex. | Feed | 100° C. K.V. (cSt) | −40° C. K.V. (cSt) | VI | Noack Volatility (wt. %) |
| Ref C | C10 | 5.80 | 7800 | 136 | 7.5 |
| 10B | C10 | 5.86 | 7959 | 137 | 6.6 |
| Ref D | 10:60:30 C8:C10:C12 | 5.86 | 7712 | 138 | 6.6 |
| 11B | 60:40 C10:C12 | 5.90 | 7200 | 143 | 6.0 |

Blends According to the Invention.

The composition according to the invention comprises: (a) at least one Group II basestock; and (b) at least one PAO according to the invention.

In an embodiment, component (a) of the composition is present in the amount of about 1 to 99 vol. %, and component (b) is present in the amount of about 1 to 99 vol. %. In another embodiment, component (a) is present in the amount of about 30 to 90 vol. %, and component (b) is present in the amount of about 10 vol % to about 70 vol. %. In still another embodiment, component (a) is present in the amount of greater than 30 to about 80 vol. %, and component (b) is present in the amount of about 20 vol % to less than 70 vol. %. Additional embodiments envisioned include amounts from any lower limit given to any upper limit given, and thus, by way of further example, component (a) may be present in the amount of about 1 to 80 vol. %, and component (b) may be present in the amount of about 20 to 99 vol. %. Percentages are based on the volume of the entire composition.

The blend of at least one Group II material and PAO according to the invention may be used by itself as a functional fluids, such as a carrier or diluent, or it may be further blended with other basestocks and/or additives, such as one or more additives selected from detergents, anti-wear additives, extreme pressure additives, viscosity index improvers, antioxidants, dispersants, pour point depressants, corrosion inhibitors, seal compatibility agents, antifoam agents, and the like, discussed more fully below. Fully formulated lubricants are useful for lubricating engines, industrial and automotive gearsets, and the like. A blend according to the invention is particularly useful for preparing SAE Grade 0W20, 0W30, and 0W40 multi-grade engine oils. One of ordinary skill in the art, in possession of the present disclosure, can prepare such useful products without undue experimentation.

PAOs suitable for use in the present invention were synthesized and the Noack volatility vs. CCS @ −35° C. (FIG. 1) and Noack volatility vs. KV at 100° C. (FIGS. 2 and 3) relationships are shown relative to existing commercial products. The curves shown were generated using an Excel graphing function, illustrating approximate boundary functions for PAOs according to the present invention.

In FIG. 1, "C10 trimer" is a low volatility, low viscosity PAO according to the invention, taken as overheads from the third distillation column (i.e., after a first distillation removing unreacted monomers and promoters, an hydrogenation step, and second distillation to remove dimers). The "C10/C12 trimer (1)" is taken in the same fashion, but using a feed of 55 vol. % C10, remainder C12, and having a KV100=3.9 cSt. The "C10/C12 trimer (2)" is taken in the same fashion, overhead, but using a feed of 60 vol. % C10, remainder C12, and having a KV100=4.1 cSt; the "C10/C12 oligomer (3)" is the bottoms product using this feed and has a KV100 of 5.9 cSt. "C10/C12 oligomer (3)" is referred to in the drawings as "C10/C12 trimer (3)".

Figure 2:
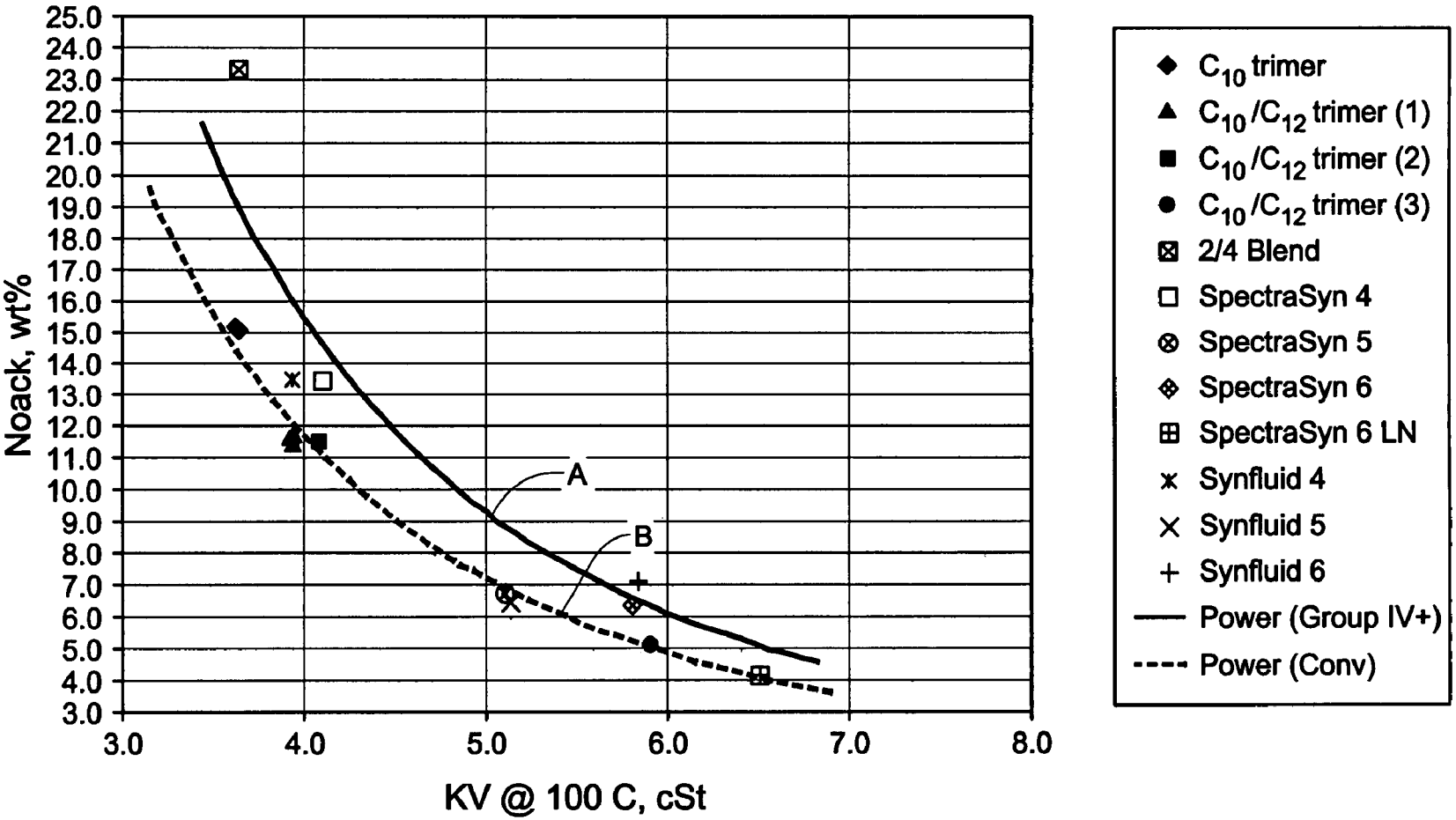
FIG. 2 illustrates the relationship of Noack Volatility versus Kinematic Viscosity @ 100° C. for PAOs according to the present invention compared with prior art compositions.

Also shown on FIGS. 1 and 2 are commercial products as identified and also a "2/4" mixture of conventional PAOs made without dual promoter system, having a nominal viscosity of 2 cSt and 4 cSt, respectively. The top curve (A) in each graph is drawn through data points representing existing products and the bottom curve (B) is drawn through data points representing products according to the present invention. These curves are directly from Excel graphing/power fit functions. It should be noted that although certain existing commercial products appear below the "B" curves, such products do not have pour points less than −54° C.

Figure 3:
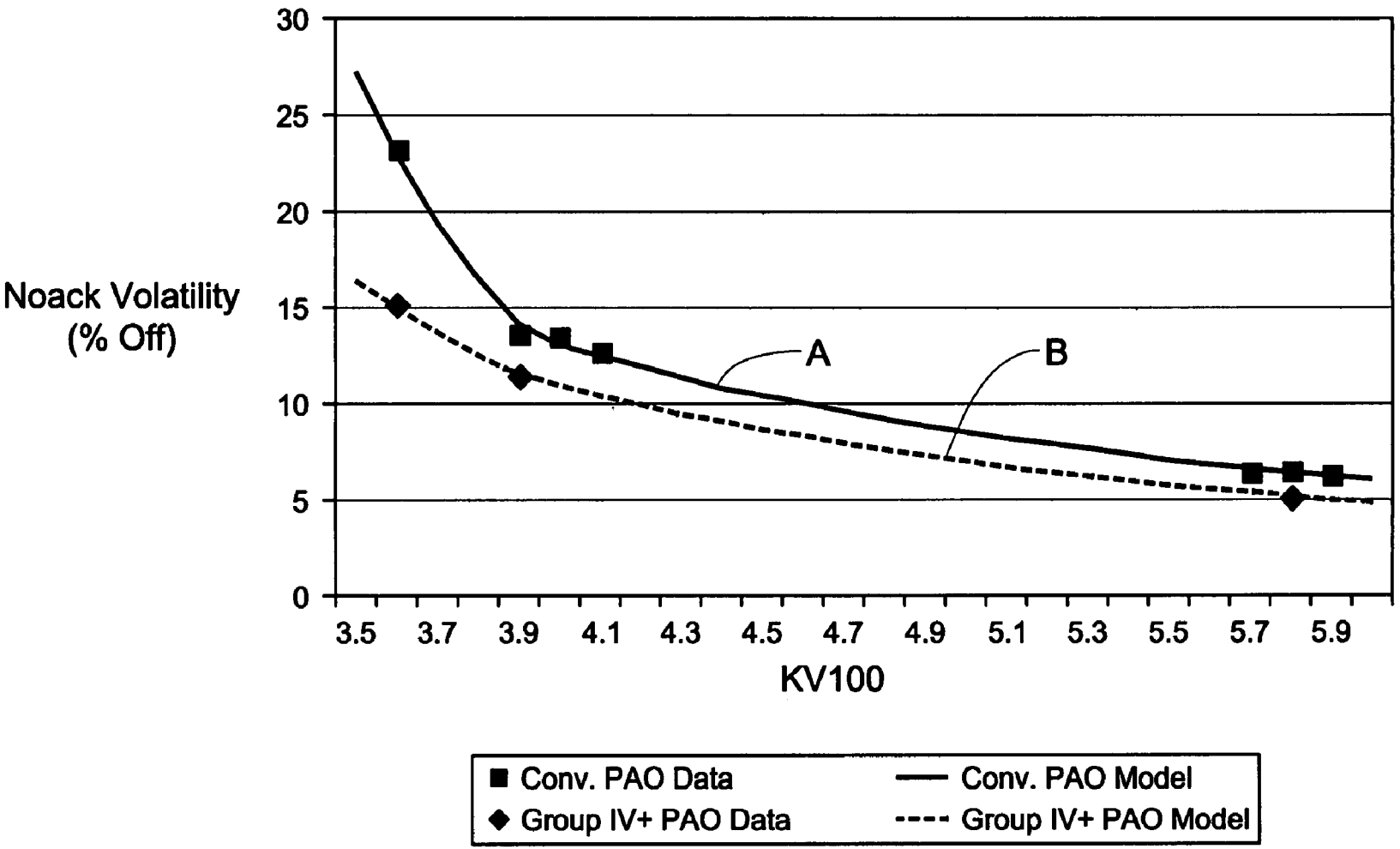
FIG. 3 is similar to FIG. 2, except that the curves are idealized using a smaller set of data points.

FIG. 3 is similar to FIG. 2 and used to demonstrate a mathematical relationship between Noack volatility and Kinematic Viscosity at 100° C. (KV100) for both conventional low viscosity PAO and the low volatility, low viscosity PAO according to the present invention. In both sets of PAO data (curves A and B), the curve is segmented between 3.5 and 3.95 cSt for one relationship, and then redefined for products between 3.95 and 6 cSt. Curve A, drawn through data points of conventional PAO may be described by the following equation: (ia) within the range of 3.5 to 3.95 cSt at 100° C. the Noack volatility=$(50{,}000)(KV100)^{-6}$; and (ib) within the range of greater than 3.95 to 6 cSt at 100° C. the Noack volatility=$(182)(KV100)^{-1.9}$. Curve B, drawn through data points representing PAOs according to the invention, may be described by the following equation: (iia) within the range of 3.5 to 3.95 cSt at 100° C. the Noack Volatility=$(900)(KV100)^{-3.2}$; and (iib) within the range of greater than 3.95 to 6 cSt at 100° C. the Noack Volatility=$(175)(KV100)^{-2}$. These equations closely model the actual relationship between Noack volatility and kinematic viscosity at 100° C. for both classes of PAO. The clear difference in Noack volatility vs. kinematic viscosity at 100° C. for the present invention PAO, combined with its pour point <−54° C. provides significant advantage in blending many finished lubricants over prior art PAO.

In a preferred embodiment, the PAO according to the invention is characterized as having a pour point less than −54° C., and at least one of the following: (i) a Noack volatility (wt. %) versus Cold Crank Simulator test (CCS) at −35° C. relationship about equal to or better than (below the curve) described by Curve A or preferably Curve B in FIG. 1, these curves also characterized by the equations: Noack volatility (wt. %)=(6473.1)(CCS @ −35° C., in cP)$^{-0.834}$ and Noack volatility (wt. %)=(500)(CCS @ −35° C., in cP)$^{-0.83}$, respectively; (ii) a Noack volatility (wt. %) versus Kinematic Viscosity @ 100° C. (KV100) relationship about equal to or better than (below the curve) described by Curve A or preferably Curve B in FIG. 2, these curves also characterized by the equations: Noack volatility (wt. %)=(354.75)(CCS @ −35C, in cP)$^{-2.2629}$ and Noack volatility (wt. %)=(234.58)(CCS @ −35 C, in cP)$^{-2.1632}$, respectively; and (iii) a Noack volatility (wt. %) versus Kinematic Viscosity relationship about equal to or better than (below the curve) described by Curve A or preferably Curve B in FIG. 3.

In a preferred embodiment, the PAO according to the invention is characterized by a pour point less than −54° C., and a Noack volatility to KV at 100° C. (KV100) relationship such that: in an embodiment (ia) within the range of 3.5 to 3.95 cSt at 100° C. the Noack volatility (wt. %)=(50,000)(KV100)$^{-6}$, and (ib) within the range of greater than 3.95 to 6 cSt at 100° C. the Noack volatility=(182)(KV100)$^{-1.9}$ or in another embodiment (iia) within the range of 3.5 to 3.95 cSt at 100° C. the Noack Volatility=(900)(KV)$^{-3.2}$; and (iib) within the range of greater than 3.95 to 6 cSt at 100° C. the Noack Volatility=(175)(KV)$^{-2}$.

Blend—Experimental

As with the previous examples, the following are meant to illustrate the present invention and also to provide a comparison with other methods and the products produced therefrom. Numerous modifications and variations are possible and it is to be understood that within the scope of the appended claims, the invention may be practiced otherwise than as specifically described herein.

Table 5 below illustrate the formulation of PAOs according to the invention with Group II basestocks that meet SAE Grade 0W multigrade engine oil requirements.

TABLE 5

| | Kin. Visc @ 100 C. (cSt) | Noack Volatility | % Each | Blend Estimates: Kin. Visc. @ 100 c. (cSt) | Blend Estimates: Noack Volatility | Blend Estimates: CCS @ −35 C. (cP) |
|---|---|---|---|---|---|---|
| Grp II+ EHC45 | 4.6 | 15.0 | 50% | | | |
| Grp IV+ 4 cSt | 3.9 | 11.4 | 50% | | | |
| Blend | | | | 4.2 | 13.2 | 2,420 |
| Grp II+ EHC45 | 4.6 | 15.0 | 25% | | | |
| Grp IV+ 4 cSt | 3.9 | 11.4 | 75% | | | |
| Blend | | | | 4.1 | 12.3 | 1,779 |

Table 5 above illustrates how greater than 30% of conventional Group II basestocks blended with this new class of PAO can yield approximately the same low temperature viscosity and Noack volatility as 100% conventional PAO. "Grp IV+" identifies the low volatility, low viscosity PAO basestocks according to the present invention.

TABLE 6

| | Viscosity Grade: 0W-30 | Viscosity Grade: 0W-30 | Viscosity Grade: 0W-40 | SAE Requirements |
|---|---|---|---|---|
| EHC45 | 35.0 | 36.0 | 30.0 | |
| MCP2511 | 42.3 | 44.7 | 47.2 | |
| Infineum P6026- DDI | 12.9 | 12.9 | 12.9 | |

TABLE 6-continued

| | Viscosity Grade: 0W-30 | Viscosity Grade: 0W-30 | Viscosity Grade: 0W-40 | SAE Requirements |
|---|---|---|---|---|
| Infineum C9440-Friction Modifier | 0.45 | 0.45 | 0.45 | |
| Infineum SV201-VII | 9.4 | 6.0 | 9.4 | |
| | 100.0 | 100.0 | 100.0 | |
| KV @ 100° C., cSt | 11.97 | 9.3 | | 9.3-<12.4 |
| KV @ 100° C., cSt | | | 12.65 | 12.5-<16.3 |
| VI | | | | |
| Pour Point, ° C. | | | | |
| CCS @: | | | | |
| −35° C., cP | 6180 | 5493 | 5579 | 6,200 Max |
| HTHS @ 150° C. | | | | |
| Apparent Viscosity, cP | | | | 2.9-3.4 |
| MRV-TP1 @ −40° C.: | | | | |
| Apparent Viscosity, cP | | | 26647 | 60,000 Max |
| Base Oil Predicted Noack, % | | | 9.9 | |

Table 6 above illustrates how greater than 30% of conventional Group II basestocks blended with this new class of PAO can yield approximately the same low temperature viscosity and Noack volatility as 100% conventional PAO. "Grp IV+" identifies the low volatility, low viscosity PAO basestocks according to the present invention.

In an embodiment, the mixture of Group II and Group IV basestocks according to the invention are used with additional lubricant components in effective amounts to form lubricant compositions. Additional ingredients may include, for example, other polar and/or non-polar lubricant base stocks (such as API Group I, III, V, and mixtures thereof), and performance additives, such as, for example, but not limited to, oxidation inhibitors, metallic and non-metallic dispersants, metallic and non-metallic detergents, corrosion and rust inhibitors, metal deactivators, anti-wear agents (metallic and non-metallic, phosphorus-containing and non-phosphorus, sulfur-containing and non-sulfur types), extreme pressure additives (metallic and non-metallic, phosphorus-containing and non-phosphorus, sulfur-containing and non-sulfur types), anti-seizure agents, pour point depressants, wax modifiers, viscosity modifiers, seal compatibility agents, friction modifiers, lubricity agents, anti-staining agents, chromophoric agents, defoamants, demulsifiers, emulsifiers, thickeners (sometimes also referred to as VI improvers, exemplified by PIB, some PMAs, and the like), fuel stabilizers, tackifiers, and others, depending on the use to which the composition is put.

For example, fuel stabilizers re added to two cycle engines where the fuel and lube intermix. Demulsifiers are added to lubricant compositions that are expected to come into contact with water, while emulsifiers are primarily used in metal working.

For a review of many commonly used additives see Klamann in Lubricants and Related Products, Verlag Chemie, Deerfield Beach, Fla.; ISBN 0-89573-177-0, which gives a good discussion of a number of the lubricant additives discussed mentioned below. Reference is also made to "Lubricant Additives" by M. W. Ranney, published by Noyes Data Corporation of Parkridge, N.J. (1973).

In preferred embodiments, a lubricant composition according to the present invention will comprise the Group II/Group IV blend according to the invention and at least one ingredient selected from the following.

Detergents

Suitable detergents include one or more alkali or alkaline earth metal salts of sulfates, phenates, carboxylates, phosphates, and salicylates.

Sulfonates may be prepared from sulfonic acids that are typically obtained by sulfonation of alkyl substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 carbon or more carbon atoms, more typically from about 16 to 60 carbon atoms.

Ranney in "Lubricant Additives" op cit discloses a number of overbased metal salts of various sulfonic acids that are useful as detergents and dispersants in lubricants. The book entitled "Lubricant Additives", C. V. Smallheer and R. K. Smith, published by the Lezius-Hiles Co. of Cleveland, Ohio (1967), similarly discloses a number of overbased sulfonates, which are useful as dispersants/detergents.

Alkaline earth phenates are another useful class of detergent. These detergents are made by reacting alkaline earth metal hydroxide or oxide (CaO, Ca(OH)2, BaO, Ba(OH)2, MgO, Mg(OH)2, for example) with an alkyl phenol or sulfurized alkylphenol. Useful alkyl groups include straight chain or branched C1-C30 alkyl groups, preferably C4-C20. Examples of suitable phenols include isobutylphenol, 2-ethylhexylphenol, nonylphenol, 1-ethyldecylphenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids other than salicylic acid are also used as detergents. These carboxylic acid detergents are prepared by a method analogous to that used for salicylates.

Alkaline earth metal phosphates are also used as detergents.

Detergents may be simple detergents or what is known as hybrid or complex detergents. The latter detergents can provide the properties of two detergents without the need to blend separate materials. See U.S. Pat. No. 6,034,039, for example, which is incorporated herein by reference in its entirety. In preferred embodiment, the total detergent concentration is about 0.01 to about 6.0 weight percent, preferably, 0.1 to 0.4 weight percent, based on the weight of the entire composition.

Anti-Wear and Extreme Pressure (EP) Additives

Internal combustion engine lubricating oils typically include the presence of anti-wear and/or extreme pressure additives in order to provide adequate anti-wear protection for the engine. Increasingly, specifications for engine oil performance have exhibited a trend for improved anti-wear properties of the oil. Anti-wear and EP additives perform this role by reducing friction and wear of metal parts.

While there are many different types of anti-wear additives, for several decades the principal anti-wear additive for internal combustion engine crankcase oils has been a metal alkylthiophosphate and more particularly a metal dialkyldithiophosphate in which the primary metal constituent is zinc, or zinc dialkyldithiophosphate (ZDDP). ZDDP compounds are generally of the formula $Zn[SP(S)(OR1)(OR2)]_2$ where R1 and R2 are C1-C18 alkyl groups, preferably C2-C12 alkyl groups. These alkyl groups may be straight chain or branched and may be derived from primary and/or secondary alcohols and/or alkylaryl groups such as alkyl phenols. The ZDDP is typically used in amounts of from about 0.4 to 1.4 weight percent of the total lube oil composition, although more or less can often be used advantageously.

However, it has been found that the phosphorus from these additives has a deleterious effect on the catalyst in catalytic converters and also on oxygen sensors in automobiles. One way to minimize this effect is to replace some or all of the ZDDP with phosphorus-free, anti-wear additives.

A variety of non-phosphorus additives have also been used as anti-wear additives. Sulfurized olefins are useful as anti-wear and EP additives. Sulfur-containing olefins can be prepared by sulfurization or various organic materials including aliphatic, arylaliphatic or alicyclic olefinic hydrocarbons containing from about 3 to 30 carbon atoms, preferably about 3 to 20 carbon atoms. The olefinic compounds contain at least one non-aromatic double bond. Such compounds are defined by the formula $$R^3R^4C{=}CR^5R^6$$

where each of $R^3$, $R^4$, $R^5$, $R^6$ are independently hydrogen or a hydrocarbon radical. Preferred hydrocarbon radicals are alkyl or alkenyl radicals. Any two of $R^3$, $R^4$, $R^5$, and $R^6$ may be connected so as to form a cyclic ring. Additional information concerning sulfurized olefins and their preparation can be found in U.S. Pat. No. 4,941,984, incorporated by reference herein in its entirety.

The use of polysulfides of thiophosphorus acids and thiophosphorus acid esters as lubricant additives is disclosed in U.S. Pat. Nos. 2,443,264; 2,471,115; 2,526,497; and 2,591,577. Addition of phosphorothionyl disulfides as anti-wear, antioxidant, and EP additives is disclosed in U.S. Pat. No. 3,770,854. Use of alkylthiocarbamoyl compounds (bis(dibutyl)thiocarbamoyl, for example) in combination with a molybdenum compound (oxymolybdenum diisopropylphosphorodithioate sulfide, for example) and a phosphorus ester (dibutyl hydrogen phosphite, for example) as anti-wear additives in lubricants is disclosed in U.S. Pat. No. 4,501,678. U.S. Pat. No. 4,758,362 discloses use of a carbamate additive to provide improved anti-wear and extreme pressure properties. The use of thiocarbamate as an anti-wear additive is disclosed in U.S. Pat. No. 5,693,598. Thiocarbamate/molybdenum complexes such as moly-sulfur alkyl dithiocarbamate trimer complex (R=C8-C18 alkyl) are also useful anti-wear agents.

Esters of glycerol may be used as anti-wear agents. For example, mono-, di-, and tri-oleates, mono-palmitates and mono-myristates may be used.

ZDDP has been combined with other compositions that provide anti-wear properties. U.S. Pat. No. 5,034,141 discloses that a combination of a thiodixanthogen compound (octylthiodi-xanthogen, for example) and a metal thiophosphate (ZDDP, for example) can improve anti-wear properties. U.S. Pat. No. 5,034,142 discloses that use of a metal alkyoxyalkylxanthate (nickel ethoxy-ethylxanthate, for example) and a dixanthogen (diethoxyethyl dixanthogen, for example) in combination with ZDDP improves anti-wear properties.

Preferred anti-wear additives include phosphorus and sulfur compounds such as zinc dithiophosphates and/or sulfur, nitrogen, boron, molybdenum phosphorodithioates, molybdenum dithiocarbamates and various organo-molybdenum derivatives including heterocyclics (including dimercaptothia-diazoles, mercaptobenzothiazoles, triazines and the like), alicyclics, amines, alcohols, esters, diols, triols, fatty amides and the like can also be used. In preferred embodiment, such additives may be used in an amount of about 0.01 to 6 weight percent, preferably about 0.01 to 4 weight percent, based on the weight of the entire composition.

Viscosity Index Improvers

Viscosity index improvers (also known as VI improvers, viscosity modifiers, and viscosity improvers) provide lubricants with high and low temperature operability. These additives impart shear stability at elevated temperatures and acceptable viscosity at low temperatures.

Suitable viscosity index improvers include high molecular weight hydrocarbons, olefin polymers and copolymers, polyesters and viscosity index improver dispersants that function as both a viscosity index improver and a dispersant. Typical molecular weights of these polymers range from about 10,000 to about 1,000,000, more typically about 20,000 to about 500,000, and even more typically between about 50,000 and about 200,000.

Examples of suitable viscosity index improvers are polymers and copolymers of methacrylate, butadiene, olefins, or alkylated styrenes. Polyisobutylene (PIB) is a commonly used viscosity index improver. Another suitable viscosity index improver is PMA or polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of about 50,000 to 200,000 molecular weight.

In one embodiment of the present invention, viscosity index improvers are used in an amount of about 0.01 to 6 weight percent, preferably about 0.01 to 4 weight percent, based on the weight of the entire composition.

Antioxidants

Antioxidants retard the oxidative degradation of base stocks during service. Such degradation may result in deposits on metal surfaces, the presence of sludge, or a viscosity increase in the lubricant. A wide variety of oxidation inhibitors that are useful in lubricating oil compositions are well known. See, Klamann in Lubricants and Related Products, op cit., and U.S. Pat. Nos. 4,798,684 and 5,084,197, for example, the disclosures of which are incorporated by reference herein in their entirety.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics that contain a sterically hindered hydroxyl group, and these include those derivatives of dihydroxy aryl compounds in which the hydroxyl groups are in the o- or p-position to each other. Typical phenolic antioxidants include the hindered phenols substituted with C6+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include, for example, hindered 2,6-di-alkyl-phenolic propionic ester derivatives. Bis-phenolic antioxidants may also be advantageously used in combination with the instant invention. Examples of ortho coupled phenols include: 2,2'-bis(6-t-butyl-4-heptyl phenol); 2,2'-bis(6-t-butyl-4-octyl phenol); and 2,2'-bis(6-t-butyl-4-dodecyl phenol). Para coupled bis phenols include, for example, 4,4'-bis(2,6-di-t-butyl phenol) and 4,4'-methylene-bis(2,6-di-t-butyl phenol).

Non-phenolic oxidation inhibitors that may be used include aromatic amine antioxidants and these may be used either as such or in combination with phenolics. Typical examples of non-phenolic antioxidants include: alkylated and non-alkylated aromatic amines such as the aromatic monoamines of the formula R8R9R10N where R8 is an aliphatic, aromatic or substituted aromatic group, R9 is an aromatic or a substituted aromatic group, and R10 is H, alkyl, aryl or R11S(O)XR12 where R11 is an alkylene, alkenylene, or aralkylene group, R12 is a higher alkyl group, or an alkenyl, aryl, or alkaryl group, and x is 0, 1 or 2. The aliphatic group R8 may contain from 1 to about 20 carbon atoms, and preferably contains from 6 to 12 carbon atoms. The aliphatic group is a saturated aliphatic group. Preferably, both R8 and R9 are aromatic or substituted aromatic groups, and the aromatic group may be a fused ring aromatic group such as naphthyl. Aromatic groups R8 and R9 may be joined together with other groups such as S.

Typical aromatic amine antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenyl-alpha-naphthylamine; phenyl-alpha-naphthylamine; and p-octylphenyl-alpha-naphthylamine.

Sulfurized alkyl phenols and alkali or alkaline earth metal salts thereof also are useful antioxidants. Low sulfur peroxide decomposers are useful as antioxidants.

Another class of antioxidant used in lubricating oil compositions is oil-soluble copper compounds. Amy oil-soluble suitable copper compound may be blended into the lubricating oil. Examples of suitable copper antioxidants include copper dihydrocarbyl thio or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are known to be particularly useful.

Preferred antioxidants include hindered phenols, arylamines, low sulfur peroxide decomposers and other related components. These antioxidants may be used individually by type or in combination with one another. In preferred embodiments, such additives may be used in an amount of about 0.01 to 5 weight percent, preferably about 0.01 to 1.5 weight percent, based on the weight of the entire composition.

Dispersants

During engine operation, oil insoluble oxidation byproducts are produced. Dispersants help keep these byproducts in solution, thus diminishing their deposit on metal surfaces. Dispersants may be ashless or ash-forming in nature. Preferably, the dispersant is ashless. So-called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain about 50 to 400 carbon atoms.

Chemically, many dispersants may be characterized as phenates, sulfonates, sulfurized phenates, salicylates, naphthenates, stearates, carbamates, thiocarbamates, and phosphorus derivatives. A particularly useful class of dispersants is the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule, which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374; and 4,234,435. Other types of dispersants are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; and 5,705,458, which are fully incorporated by reference. A further description of dispersants may be found, for example, in European Patent Application 471071, which is incorporated by reference.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; 3,652,616; 3,948,800; and Canada Patent 1,094,044, which are incorporated herein in their entirety by reference.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305, incorporated herein by reference.

The molecular weight of the alkenyl succinic anhydrides used in the preceding paragraphs will range between about 800 and 2,500 or more. The hydrocarbyl groups may be, for example, a group such as polyisobutylene having a molecular weight of about 500 to 5,000 or a mixture of such groups. The above products can be post-reacted with various reagents such as sulfur, oxygen, formaldehyde, carboxylic acids such as oleic acid, hydrocarbyl dibasic acids or anhydrides, and boron compounds such as borate esters or highly borated dispersants. In one embodiment according to the present invention, the dispersants are borated with from about 0.1 to about 5 moles of boron per mole of dispersant reaction product, including those derived from mono-succinimide, bis-succinimide (also known as disuccinimides), and mixtures thereof.

Mannich base dispersants are made from the reaction of alkylphenols, formaldehyde, and amines. See U.S. Pat. No. 4,767,551, which is incorporated herein by reference. Process acids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039, which are incorporated herein in their entirety by reference.

Typical high molecular weight aliphatic acid modified Mannich condensation products useful in this invention can be prepared from high molecular weight alkyl-substituted hydroxyaromatics or HN(R)2 group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as BF3, of phenol with high molecular weight polypropylene, polybutylene, and other polyalkylene compounds to give alkyl substituents on the benzene ring of phenol having an average of from about 600 to about 100,000 molecular weight.

Examples of HN(R)2 group-containing reactants are alkylene polyamines, principally polyethylene polyamines. Other representative organic compounds containing at least one HN(R)2 group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamide reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula H2N—(Z—NH-)nH, mentioned before, Z is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloro alkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (such as paraformaldehyde and formalin), acetaldehyde and aldol (b-hydroxybutyraldehyde, for example). Formaldehyde or a formaldehyde-yielding reactant is preferred.

Hydrocarbyl substituted amine ashless dispersant additives are well known to one skilled in the art; see, for example, U.S. Pat. Nos. 3,275,554; 3,438,757; 3,565,804; 3,755,433; 3,822,209; and 5,084,197, which are incorporated herein in their entirety by reference.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a number average molecular weight (Mn) of from about 500 to about 5,000 or a mixture of such hydrocarbylene groups. Other preferred dispersants include succinic acid-esters and amides, alkylphenol-polyamine coupled Mannich adducts, their capped derivatives, and other related components. In one embodiment, such additives are used in an amount of about 0.1 to 20 weight percent, preferably about 0.1 to 8 weight percent.

Pour Point Depressants

Conventional pour point depressants (also known as lube oil flow improvers) may be added to the compositions of the present invention if desired. The pour point depressant may be added to lubricating compositions of the present invention to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715, which are fully incorporated by reference, describe useful pour point depressants and/or the preparation thereof. In one embodiment of the present invention, such additives are used in an amount of about 0.01 to 5 weight percent, preferably about 0.01 to 1.5 weight percent.

Corrosion Inhibitors

Corrosion inhibitors are used to reduce the degradation of metallic parts that are in contact with the lubricating oil composition. Suitable corrosion inhibitors include thiadiazoles and triazoles. See, for example, U.S. Pat. Nos. 2,719,125; 2,719,126; and 3,087,932, which are incorporated herein by reference in their entirety. In one embodiment of the present invention, such additives are used in an amount of about 0.01 to 5 weight percent, preferably about 0.01 to 1.5 weight percent.

Seal Compatibility Additives

Seal compatibility agents help to swell elastomeric seals by causing a chemical reaction in the fluid or a physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Additives of this type are commercially available. In one embodiment of the present invention, such additives are used in an amount of about 0.01 to 3 weight percent, preferably about 0.01 to 2 weight percent.

Anti-Foam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide anti-foam properties. Anti-foam agents are commercially available and may be used in conventional minor amounts along with other additives such as demulsifiers. Usually the amount of these additives combined is less than 1 percent and often less than 0.1 percent.

Inhibitors and Anti-Rust Additives

Anti-rust additives (or corrosion inhibitors) are additives that protect lubricated metal surfaces against chemical attack by water or other contaminants. A wide variety of these are commercially available; they are referred to also in Klamann in Lubricants and Related Products, op cit.

One type of anti-rust additive is a polar compound that wets the metal surface preferentially, protecting it with a film of oil. Another type of anti-rust additive absorbs water by incorporating it in a water-in-oil emulsion so that only the oil touches the metal surface. Yet another type of anti-rust additive chemically adheres to the metal to produce a non-reactive surface. Examples of suitable additives include zinc dithiophosphates, metal phenolates, basic metal sulfonates, fatty acids and amines. In one embodiment of the present invention, such additives are used in an amount of about 0.01 to 5 weight percent, preferably about 0.01 to 1.5 weight percent.

Typical Additive Amounts

When lubricating oil compositions contain one or more of the additives discussed above, the additive(s) are blended into the composition in an amount sufficient for it to perform its intended function. Typical amounts of such additives useful in the present invention are shown in Table 7 below.

Note that many of the additives are shipped from the manufacturer and used with a certain amount of processing oil solvent in the formulation. Accordingly, the weight amounts in Table 7, as well as other amounts mentioned in this patent, are directed to the amount of active ingredient (that is the non-solvent portion of the ingredient). The weight percents indicated below are based on the total weight of the lubricating oil composition.

TABLE 7

Typical Amounts of Various Lubricant Components

| Compound | Approximate Weight Percent (Useful) | Approximate Weight Percent (Preferred) |
|---|---|---|
| Detergent | 0.01-6 | 0.01-4 |
| Dispersant | 0.1-20 | 0.1-8 |
| Friction Reducer | 0.01-5 | 0.01-1.5 |
| Viscosity Index Improver | 0.01-40 | 0.01-30, preferably 0.01-15 |
| Antioxidant | 0.01-5 | 0.01-2.0 |
| Corrosion Inhibitor | 0.01-5 | 0.01-1.5 |
| Anti-wear Additive | 0.01-6 | 0.01-4 |
| Pour Point Depressant | 0.01-5 | 0.01-1.5 |
| Anti-foam Agent | 0.001-3 | 0.001-0.20 |
| Base stock | Balance | Balance |

Important physical properties set forth herein were determined in accordance with the following methods.

Kinematic Viscosity (K.V.) were measured according to ASTM D445 at the temperature indicated (e.g., 100° C. or −40° C.).

Viscosity Index (VI) was determined according to ASTM D-2270.

Noack volatility was determined according to the ASTM D5800 method, with the exception that the thermometer calibration is performed annually rather than biannually.

Pour point was determined according to ASTM D5950.

Cold Crank Simulator (CCS) test was determined according to ASTM D5293.

Trade names used herein are indicated by a ™ symbol or ® symbol, indicating that the names may be protected by certain trademark rights, e.g., they may be registered trademarks in various jurisdictions. All patents and patent applications, test procedures (such as ASTM methods, and the like), and other documents cited herein are fully incorporated by reference to the extent such disclosure is not inconsistent with this invention and for all jurisdictions in which such incorporation is permitted. When numerical lower limits and numerical upper limits are listed herein, ranges from any lower limit to any upper limit are contemplated.

The invention has been described above with reference to numerous embodiments and specific examples. Many variations will suggest themselves to those skilled in this art in light of the above detailed description. All such obvious variations are within the full intended scope of the appended claims.

What is claimed is:

1. A composition comprising:

(a) at least 30 vol % of at least one API Group II basestock having a Cold Crank Simulator test at −35° C. value of greater than 2600; and (b) at least one PAO basestock characterized by a pour point <−54° C., and at least one of the following relationships: (i) a Noack volatility versus CCS relationship on or below curve B in FIG. 1; (ii) a Noack volatility to KV relationship on or below the curve B in FIG. 2; and (iii) a Noack volatility to KV relationship on or below the curve B in FIG. 3.

2. The composition according to claim 1, wherein (b) includes at least one PAO basestock further characterized by at least one of the relationships (i) and (ii).

3. The composition according to claim 1, wherein (b) includes at least one PAO basestock further characterized by both of the relationships (i) and (ii).

4. The composition according to claim 1, wherein the at least one PAO basestock is further characterized as being obtainable by a process comprising oligomerizing at least one alphaolefin in the presence of an oligomerization catalyst and a dual promoter system comprising an alcohol and an ester.

5. The composition according to claim 1, wherein the at least one PAO basestock is further characterized as being made by a process comprising oligomerizing at least one alphaolefin in the presence of an oligomerization catalyst and a dual promoter system comprising an alcohol and an ester.

6. The composition according to claim 1, wherein the at least one PAO basestock is further characterized as comprised of an oligomerized alphaolefin which has been subjected to hydrogenation, wherein said oligomerized alphaolefin is prepared from an olefin feed comprises of 50 to 80 wt. % 1-decene and 50 to 20 weight percent 1-dodecene, and wherein said oligomerized alphaolefin has been oligomerized in the presence of $BF_3$ and a dual promoter comprising at least one alcohol and at least one alkyl acetate.

7. The composition according to claim 1, wherein the at least one PAO basestock is further characterized as comprising a 5 cSt PAO comprising about 40 to 80 weight percent of 1-decene and from about 60 to about 20 weight percent of 1-dodecene based on the weight of said 5 cSt PAO.

8. The composition according to claim 1, wherein the at least one PAO basestock is further characterized as being made by a process comprising the oligomerization of alphaolefins comprising:

(a) contacting at least one alphaolefin, an alphaolefin oligomerization catalyst, an alcohol promoter, and an ester promoter in at least one continuously stirred reactor under oligomerization conditions for a time sufficient to produce a trimer of said at least one alphaolefin;

(b) distilling off unreacted alphaolefin and dimers of said alphaolefin to obtain a bottoms product comprising said trimer;

(c) hydrogenating said bottoms product to obtain a hydrogenated bottoms product; and then (d) fractionating said bottoms product to obtain at least one cut comprising a trimer product.

9. The composition according to claim 8, wherein step (a) comprises contacting at least one alphaolefin selected from C8, C10, C12, C14, and C16 alphaolefins, and mixtures thereof.

10. The composition according to claim 1, wherein the at least one PAO basestock is further characterized as being obtainable by or made by an improved process comprising contacting at least one alphaolefin, an alphaolefin oligomerization catalyst, an alcohol promoter, and an ester promoter in at least one continuously stirred reactor under oligomerization conditions for a time sufficient to produce a trimer of said at least one alphaolefin, the improvement comprising distilling off unreacted monomers and promoters in a first distillation column, taking the bottoms product from said first distillation column and distilling off dimers in a second distillation column, taking the bottoms product from said second distillation column and hydrogenating said product to produce a hydrogenated product, sending said hydrogenated product to a third distillation column, and obtaining at least one product from either the overheads or bottoms of said third distillation column.

11. The composition according to claim 1, wherein the at least one API Group II basestock is selected from solvent dewaxed API Group II basestocks, catalytically dewaxed API Group II basestocks, hydrocracked API Group II basestocks, and wax isomerate API Group II basestocks.

12. The composition according to claim 1, wherein the at least one PAO basestock is selected from at least one of (i) a PAO comprising at least 85 wt. % trimers of 1-decene and having a viscosity of about 3.6 cSt at 100° C.; and (ii) a PAO comprising at least 85 wt. % trimers of 1-decene and 1-dodecene and having a viscosity of about 3.9 cSt at 100° C.

13. A composition comprising:

(a) at least 30 vol % of at least one Group II basestock having a Cold Crank Simulator test at −35° C. value of greater than 2600; and (b) at least one PAO characterized by a pour point less than −54° C., and at least one of the following: when the PAO has a kinematic viscosity within the range of 3.5 to 3.95 cSt at 100° C. the Noack volatility=$(900)(KV)^{-3.2}$; and when the PAO has a kinematic viscosity within the range of greater than 3.95 to 6 cSt at 100° C. the Noack Volatility=$(175)(KV)^{-2}$.

14. The composition according to claim 13, wherein the at least one Group II basestock is selected from solvent dewaxed API Group II basestocks, catalytically dewaxed API Group II basestocks, hydrocracked API Group II basestocks, and wax isomerate API Group II basestocks.

15. The composition according to claim 1, wherein the composition is a fully-formulated SAE Grade 0 W multigrade lubricant composition.

16. The composition according to claim 1, wherein said at least one API Group II basestock has a CCS @ −35 of greater than 2800.

17. The composition according to claim 1, further characterized by comprising at least one additive selected from the group consisting of: oxidation inhibitors, metallic and non-metallic dispersants, metallic and non-metallic detergents, corrosion and rust inhibitors, metal deactivators, anti-wear agents, extreme pressure additives, anti-seizure agents, pour point depressants, wax modifiers, viscosity modifiers, seal compatibility agents, friction modifiers, lubricity agents, anti-staining agents, chromophoric agents, defoamants, demulsifiers, emulsifiers, thickeners, fuel stabilizers, and tackifiers.

18. An automatic transmission fluid, automotive or industrial gear oil, or hydraulic fluid comprising the composition according to claim 1.

19. The composition according to claim 1, wherein (b) of the composition consists of a single PAO basestock.

* * * * *